US007191737B2

(12) United States Patent
Klein

(10) Patent No.: US 7,191,737 B2
(45) Date of Patent: Mar. 20, 2007

(54) HYDROGEN GENERATOR FOR USES IN A VEHICLE FUEL SYSTEM

(75) Inventor: Dennis Klein, Clearwater, FL (US)

(73) Assignee: Hydrogen Technology Applications, Inc., Clearwater, FL (US)

( * ) Notice: Subject to any disclaimer, the term of this patent is extended or adjusted under 35 U.S.C. 154(b) by 292 days.

(21) Appl. No.: 11/037,700

(22) Filed: Jan. 18, 2005

(65) Prior Publication Data

US 2005/0258049 A1 Nov. 24, 2005

Related U.S. Application Data

(62) Division of application No. 10/277,841, filed on Oct. 22, 2002, now Pat. No. 6,866,756.

(51) Int. Cl.
*F02B 43/02* (2006.01)
*F02B 43/12* (2006.01)
*C25B 1/06* (2006.01)

(52) U.S. Cl. ..... 123/3; 123/DIG. 12; 205/628

(58) Field of Classification Search ..... 204/268, 204/269, 275.1, 278, 278.5, 628; 123/3, 123/DIG. 12
See application file for complete search history.

(56) References Cited

U.S. PATENT DOCUMENTS 4,200,062 A 4/1980 Duckworth
4,369,737 A 1/1983 Sanders et al.
4,622,924 A 11/1986 Lewis
4,726,888 A 2/1988 McCambridge
5,231,954 A 8/1993 Stowe
5,401,371 A 3/1995 Oshima et al.
5,711,865 A 1/1998 Caesar
5,799,624 A 9/1998 Hsieh
6,126,794 A 10/2000 Chambers
6,209,493 B1 4/2001 Ross
6,275,175 B1 * 8/2001 Kahlman et al. ..... 341/59
6,315,886 B1 11/2001 Zappi et al.
6,659,049 B2 * 12/2003 Zagaja et al. ..... 123/3

* cited by examiner

*Primary Examiner*—Roy King
*Assistant Examiner*—William T. Leader
(74) *Attorney, Agent, or Firm*—Dennis G. LaPointe

(57) ABSTRACT

The present invention discloses an electrolyzer for electrolyzing water into a gaseous mixture comprising hydrogen gas and oxygen gas. The electrolyzer is adapted to deliver this gaseous mixture to the fuel system of an internal combustion engine. The electrolyzer of the present invention comprises one or more supplemental electrode at least partially immersed in an aqueous electrolyte solution interposed between two principle electrodes. The gaseous mixture is generated by applying an electrical potential between the two principal electrodes. The electrolyzer further includes a gas reservoir region for collecting the generated gaseous mixture. The present invention further discloses a method of utilizing the electrolyzer in conjunction with the fuel system of an internal combustion engine to improve the efficiency of said internal combustion engine.

16 Claims, 5 Drawing Sheets

HYDROGEN GENERATOR FOR USES IN A VEHICLE FUEL SYSTEM

RELATED APPLICATION

This application is a divisional application of U.S. patent application Ser. No. 10/277,841 filed Oct. 22, 2002 now U.S. Pat. No. 6,866,756.

BACKGROUND OF THE INVENTION

1. Field of the Invention

The present invention is related to an apparatus and method of improving the fuel efficiency of an internal combustion engine, and in particular, to an apparatus and method for hydrolyzing water into a mixture comprising hydrogen gas and oxygen gas to be combined with fuel used in an internal combustion engine.

2. Background Art

Federal regulations force automobile manufacturers to constantly seek improvements in fuel efficiency and emissions control. Such governmental regulations have provided a significant impetus for the development of alternative fuel vehicles as well as improvements in vehicle catalytic conversion systems. Alternative fuel sources for automobile applications include natural gas, propane, wood alcohol, hydrogen fuel cells, and electricity. Although the future for each of these alternative sources is promising, considerable improvements are required for each before commercially viable products will be available.

The addition of a mixture of hydrogen gas ($H_2$) and oxygen gas ($O_2$) to the fuel system of an internal combustion engine is known to improve fuel efficiency and decrease the emission of undesired pollutants. These benefits are thought to be the result of more complete combustion induced by the presence of hydrogen such that fuel efficiency increases and incomplete combustion products—soot and carbon monoxide—decrease. However, hydrogen is a flammable gas that is potentially explosive. Accordingly, utilization of hydrogen in vehicular applications must be undertaken with caution.

The hydrolysis of water is known to produced both hydrogen gas and oxygen gas. Water is of course nonflammable and extremely safe. U.S. Pat. No. 6,209,493 B1 (the '493 patent) and U.S. Pat. No. 5,231,954 (the '954 patent) disclose an electrolysis cell that is used to provide hydrogen and oxygen to the fuel system of an internal combustion engine. The '493 patent discloses a kit that uses such an electrolysis cell to produce hydrogen and oxygen that may either be separated or mixed before the gases are introduced to a vehicle fuel system. Although each of these systems may increase fuel efficiency, each system is complicated by one or more undesirable features. For example, the prior art systems do not have components that are readily removed and replaced by the end users. Furthermore, these electrolysis systems tend to have electrodes that do not have a very high surface area. Hydrogen and oxygen can be produced more efficiently with electrodes having greater surface area.

Accordingly, there exists a need improved hydrogen-generating systems that are simple to fabricate with end-user replaceable components. Furthermore, it is desirable that such system contain electrodes with high surface areas without occupying significantly more vehicle space.

SUMMARY OF THE INVENTION

The present invention overcomes the problems encountered in the prior art by providing in one embodiment an electrolyzer for electrolyzing water into a mixture comprising hydrogen gas and oxygen gas. The electrolyzer is adapted to deliver the gaseous mixture to the fuel system of an internal combustion engine that when combusted with the fuel, the efficiency of the engine is improved. The electrolyzer of the present invention comprises:

- an electrolysis chamber;
- an aqueous electrolyte solution comprising water and an electrolyte, the aqueous electrolyte solution partially filling the electrolysis chamber such that a gas reservoir region is formed above the aqueous electrolyte solution;
- two principal electrodes comprising an anode electrode and a cathode electrode, the two principal electrodes at least partially immersed in the aqueous electrolyte solution;
- one or more supplemental electrode at least partially immersed in the aqueous electrolyte solution and interposed between the two principle electrodes that are not connected to the two principal electrodes with a metallic conductor wherein the two principal electrodes and the one or more supplemental electrodes are held in a fixed spatial relationship;
- wherein a gas mixture comprising hydrogen gas and oxygen gas is generated by applying an electrical potential between the two principle electrodes. The utilization of interposed supplemental electrodes that are interposed between the anode and cathode allows for a greatly increased electrode surface area. Furthermore, the relatively simple design of the electrodes—as rectangular or square metallic shapes allows for the electrodes to be easily replaced. The gas mixture of hydrogen and oxygen formed in this embodiment is collected in the gas reservoir region which is adapted to deliver the mixture to the fuel system of an internal combustion engine.

In another embodiment of the present invention, a method for improving the fuel efficiency of an internal combustion engine is provided. The method comprises using the electrolyzer of the present invention in conjunction with an internal combustion engine. An electrical potential is applied to the two principal electrodes of the elecrolyzer thereby caused the electrolyzer to generate a mixture of hydrogen gas and oxygen gas. The gas mixture is then combined with the fuel in the fuel system of the internal combustion engine before the fuel is combusted in the internal combustion engine.

DETAILED DESCRIPTION OF THE PREFERRED EMBODIMENT(S)

Reference will now be made in detail to presently preferred compositions or embodiments and methods of the invention, which constitute the best modes of practicing the invention presently known to the inventors.

The term "electrolyzer" as used herein refers to an apparatus that produces chemical changes by passage of an electric current through an electrolyte. The electric current is typically passed through the electrolyte by applying a voltage between a cathode and anode immersed in the electrolyte. As used herein, electrolyzer is equivalent to electrolytic cell.

The term "cathode" as used herein refers to the negative terminal or electrode of an electrolytic cell or electrolyzer. Reduction typically occurs at the cathode.

The term "anode" as used herein refers to the positive terminal or electrode of an electrolytic cell or electrolyzer. Oxidation typically occurs at the cathode.

The term "electrolyte" as used herein refers to a substance that when dissolved in a suitable solvent or when fused becomes an ionic conductor. Electrolytes are used in the electrolyzer to conduct electricity between the anode and cathode.

The term "bicarbonate" as used herein refers to a salt of carbonic acid in which one hydrogen atom has replaced. Accordingly, bicarbonate contains the bicarbonate ion $HCO_3^-$.

The term "hydroxide" as used herein refers to a metallic compound containing the hydroxide ion ($OH^-$). Hydroxides of most metals are basic.

The term "internal combustion engine" as used herein refers to any engine in which a fuel-air mixture is burned within the engine itself so that the hot gaseous products of combustion act directly on the surfaces of engine's moving parts. Such moving parts include, but are not limited to, pistons or turbine rotor blades. Internal-combustion engines include gasoline engines, diesel engines, gas turbine engines, jet engines, and rocket engines.

Figure 1:
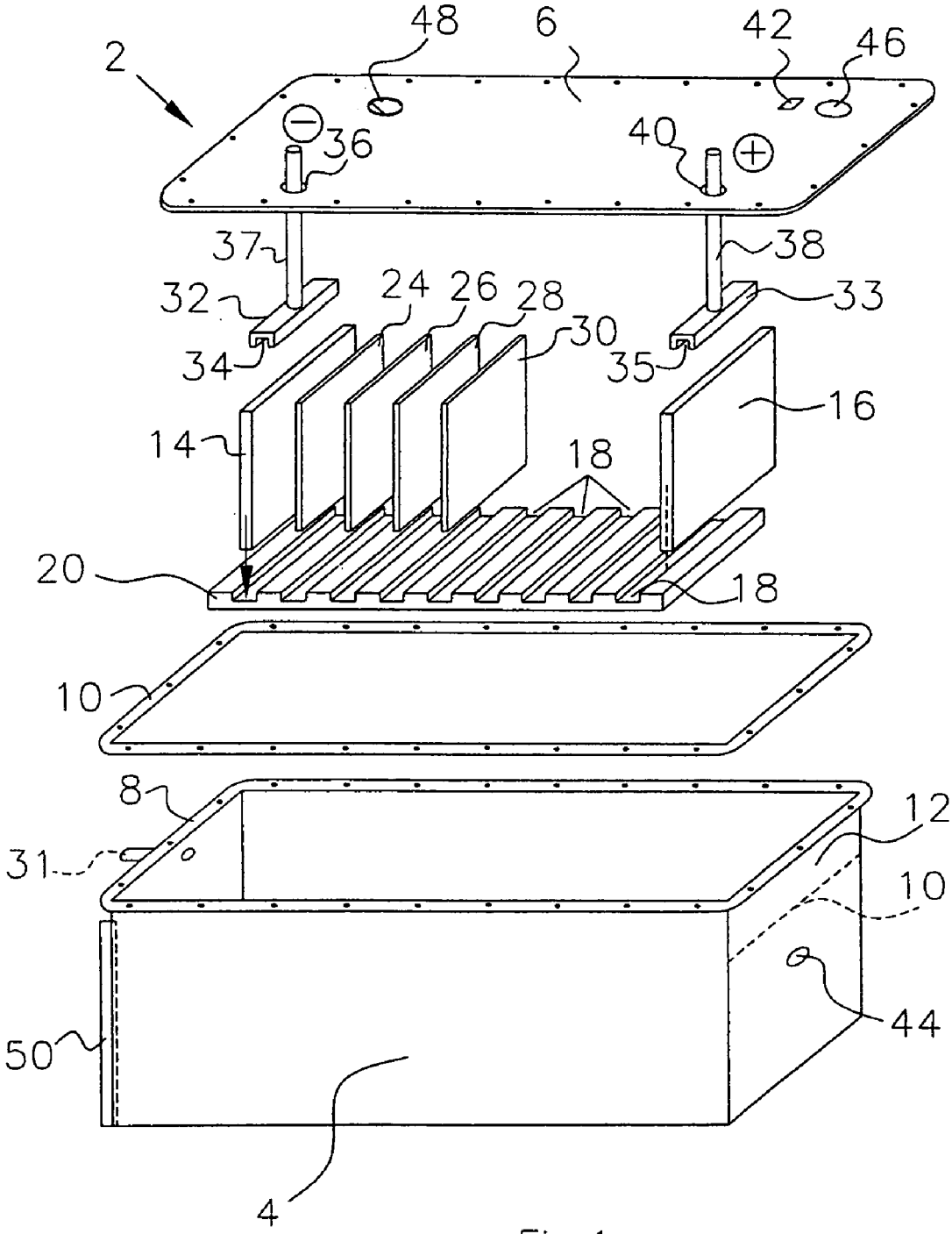
FIG. 1 is an exploded view of the electrolyzer of the present invention for improving the efficiency of an internal combustion engine.

With reference to FIG. 1 an exploded view of the electrolyzer of the present invention for improving the efficiency of an internal combustion engine is provided. Electrolyzer 2 includes electrolysis chamber 4 which holds an electrolyte solution. Electrolysis chamber 4 mates with cover 6 at flange 8. Preferably, a seal between chamber 4 and cover 6 is made by neoprene gasket 10 which is placed between flange 8 and cover 6. Preferably, the electrolyte solution is an aqueous electrolyte solution of water and an electrolyte. Although any electrolyte may be used in practicing the present invention, the preferred electrolytes are bicarbonate, hydroxide, or mixtures thereof. Suitable examples of these electrolytes include, but are not limited to, sodium bicarbonate, potassium hydroxide, sodium hydroxide, or mixtures thereof. The aqueous electrolyte solution partially fills electrolysis chamber 4 during operation to level 10 such that gas reservoir region 12 is formed above the aqueous electrolyte solution. Electrolyzer 2 includes two principle electrodes—anode electrode 14 and cathode electrode 16—which are at least partially immersed in the aqueous electrolyte solution. Anode electrode 14 and cathode electrode 16 slip into grooves 18 in rack 20. Rack 20 is placed inside chamber 4. One or more supplemental electrodes 24, 26, 28, 30 are also placed in rack 16 (not all the possible supplemental electrodes are illustrated in FIG. 1.) Again, supplemental electrodes 24, 26, 28, 30 are at least partially immersed in the aqueous electrolyte solution and interposed between the anode electrode 14 and cathode electrode 16. Furthermore, anode electrode 14, cathode electrode 16, and supplemental electrodes 24, 26, 28, 30 are held in a fixed spatial relationship by rack 20. Preferably, anode electrode 14, cathode electrode 16, and supplemental electrodes 24, 26, 28, 30 are separated by a distance of about 0.25 inches. The one or more supplemental electrodes allow for enhanced and efficient generation of this gas mixture. Preferably, there are from 1 to 50 supplemental electrodes interposed between the two principal electrodes. More preferably, there are from 5 to 30 supplemental electrodes interposed between the two principal electrodes, and most preferably, there are about 15 supplemental electrodes interposed between the two principal electrodes. Preferably, the two principle electrodes are each individually a metallic wire mesh, a metallic plate, or a metallic plate having one or more holes. More preferably, the two principle electrodes are each individually a metallic plate. A suitable metal from which the two principal electrodes are formed, includes but is not limited to, nickel, nickel containing alloys, and stainless steel. The preferred metal for the two electrodes is nickel. The one or more supplemental electrodes are preferably a metallic wire mesh, a metallic plate, or a metallic plate having one or more holes. More preferably, the one or more supplemental electrodes are each individually a metallic plate. A suitable metal from which the two principal electrodes are formed, includes but is not limited to, nickel, nickel containing alloys, and stainless steel. The preferred metal for the two electrodes is nickel.

Still referring to FIG. 1, during operation of electrolyzer 2 a voltage is applied between anode electrode 14 and cathode electrode 16 which causes a gaseous mixture of hydrogen gas and oxygen gas to be generated which collects in gas reservoir region 12. The gaseous mixture exits gas reservoir region 12 from through exit port 31 and ultimately is fed into the fuel system of an internal combustion engine. Electrical contact to anode electrode 14 is made through contactor 32 and electrical contact to cathode electrode 16 is made by contactor 33. Contactors 32 and 33 are preferably made from metal and are slotted with channels 34, 35 such that contactors 32, 33 fit over anode electrode 14 and cathode electrode 16. Contactor 32 is attached to rod 37 which slips through hole 36 in cover 6. Similarly, contactor 33 is attached to rod 38 which slips through hole 40 in cover 6. Preferable holes 36, 40 are threaded and rods 37, 38 are threads rods so that rods 37, 38 screw into holes 36, 40. Contactors 32 and 33 also hold rack 20 in place since anode electrode 14 and cathode electrode 16 are held in place by channels 34, 35 and by grooves 18 in rack 20. Accordingly, when cover 6 is bolted to chamber 4, rack 20 is held at the bottom of chamber 4. Electrolyzer 2 optionally includes pressure relief valve 42 and level sensor 44. Pressure relief 42 valve allows the gaseous mixture in the gas reservoir to be vented before a dangerous pressure buildup can be formed. Level sensor 44 ensures that an alert is sounded and the flow of gas to the vehicle fuel system is stopped when the electrolyte solution gets too low. At such time when the electrolyte solution is low, addition electrolyte solution is added through water fill port 46. Electrolyzer 2 may also include pressure gauge 48 so that the pressure in reservoir 4 may be monitored. Finally, electrolyzer 2 optionally includes one or more fins 50 which remove heat from electrolyzer 2.

Figure 2:
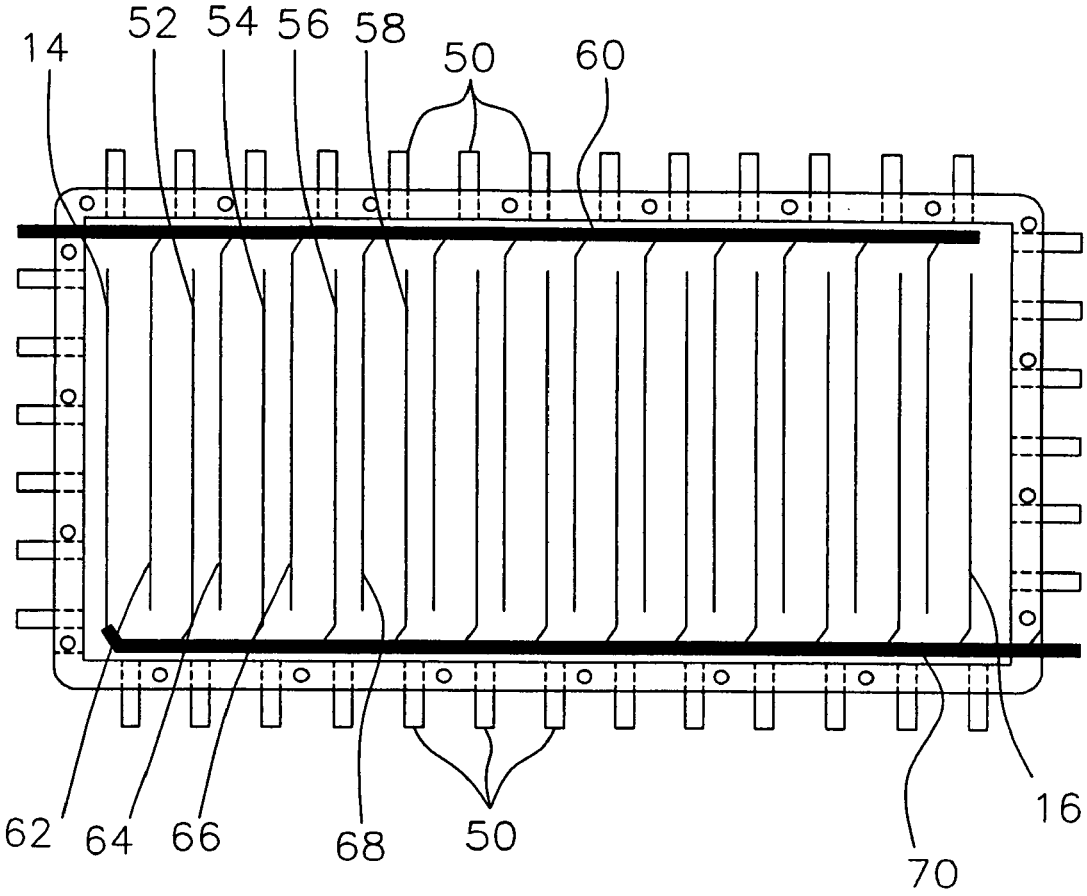
FIG. 2 is top view of a variation of the present invention in which one group of supplemental electrodes are connected to the anode electrode and a second group of supplemental electrodes are connected to the cathode electrode.

With reference to FIG. 2, a variation of the electrolyzer of the present invention is provided. A first group of the one or more supplemental electrodes 52, 54, 56, 58 are connected to anode electrode 14 with a first metallic conductor 60 and a second group of the one or more supplemental electrodes 62, 64, 66, 68 are connected to cathode electrode 16 with second metallic conductor 70.

Figure 3:
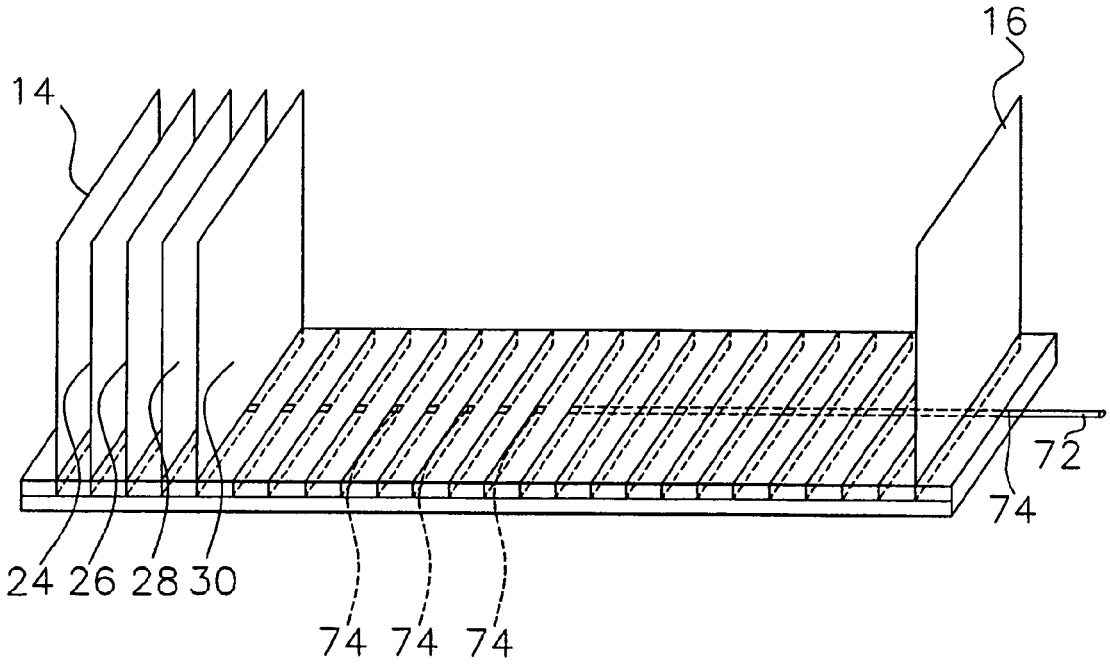
FIG. 3 is a perspective view of the electrode plate securing mechanism of the present invention is provided.

With reference to FIG. 3, a perspective view showing the electrode plate securing mechanism of the present invention is provided. Anode electrode 14, cathode electrode 16, and supplemental electrodes 24, 26, 28, 30 are held to rack 20 by holder rod 72 which slips through channels 74 in rack 20 and holes in the electrodes (not all the possible supplemental electrodes are illustrated in FIG. 3.) Rack 20 is preferably fabricated from a high dielectric plastic such as PVC, polyethylene or polypropylene. Furthermore, rack 20 holds anode electrode 14, cathode electrode 16, and supplemental electrodes 24, 26, 28, 30 in a fixed spatial relationship. Preferably, the fixed spatial relationship of the two principal electrodes and the one or more supplemental electrodes is such that the electrodes (two principal and one or more supplemental) are essentially parallel and each electrode is separated from an adjacent electrode by a distance from about 0.15 to about 0.35 inches. More preferably, each electrode is separated from an adjacent electrode by a distance from about 0.2 to about 0.3 inches, and most preferably about 0.25 inches. The fixed spatial relationship is accomplished by a rack that holds the two principal electrodes and the one or more supplemental electrodes in the fixed spatial relationship. The electrodes sit in grooves in the rack which define the separations between each electrode. Furthermore, the electrodes are removable from the rack so that the electrodes or the rack may be changed if necessary. Finally, since rack 20 and anode electrode 14 and cathode electrode 16 are held in place as set forth above, the supplemental electrodes are also held in place because they are secured to rack 20 by holder rod 72.

Figure 4:
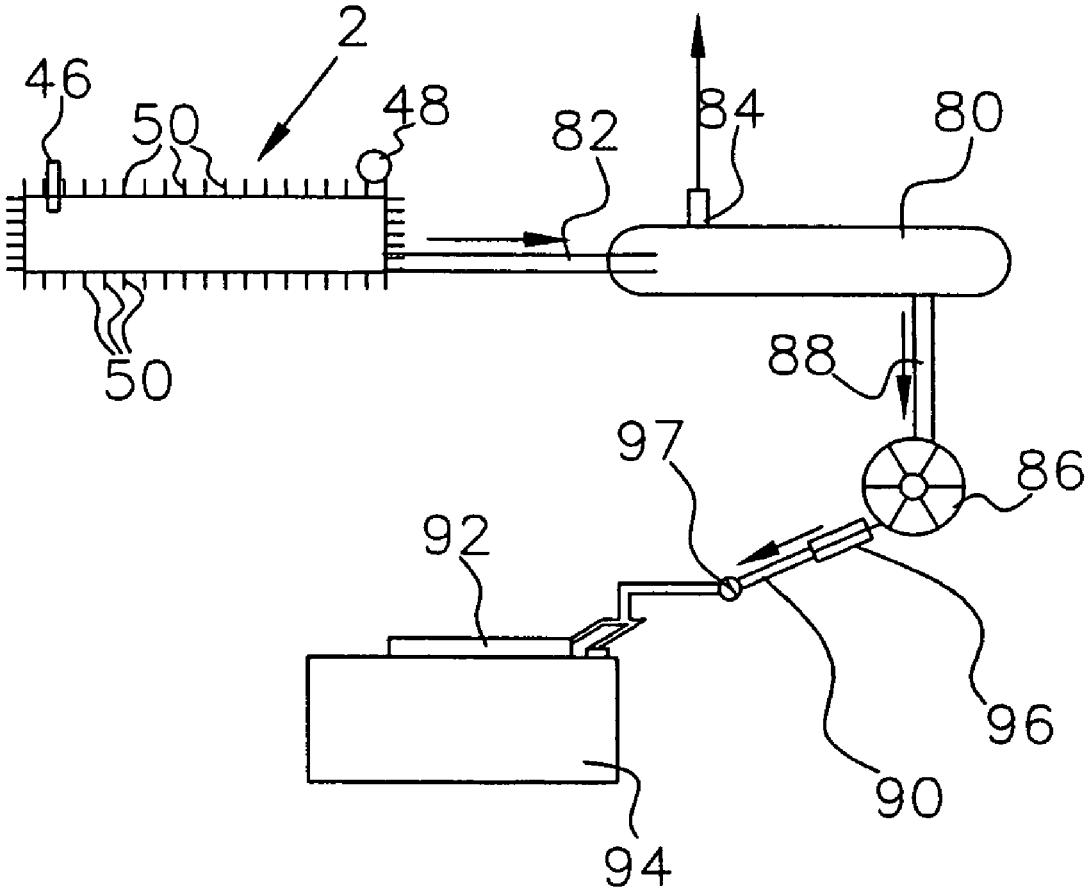
FIG. 4 is a plumbing schematic showing the integration of the electrolyzer of the present invention into a vehicle.
Figure 5:
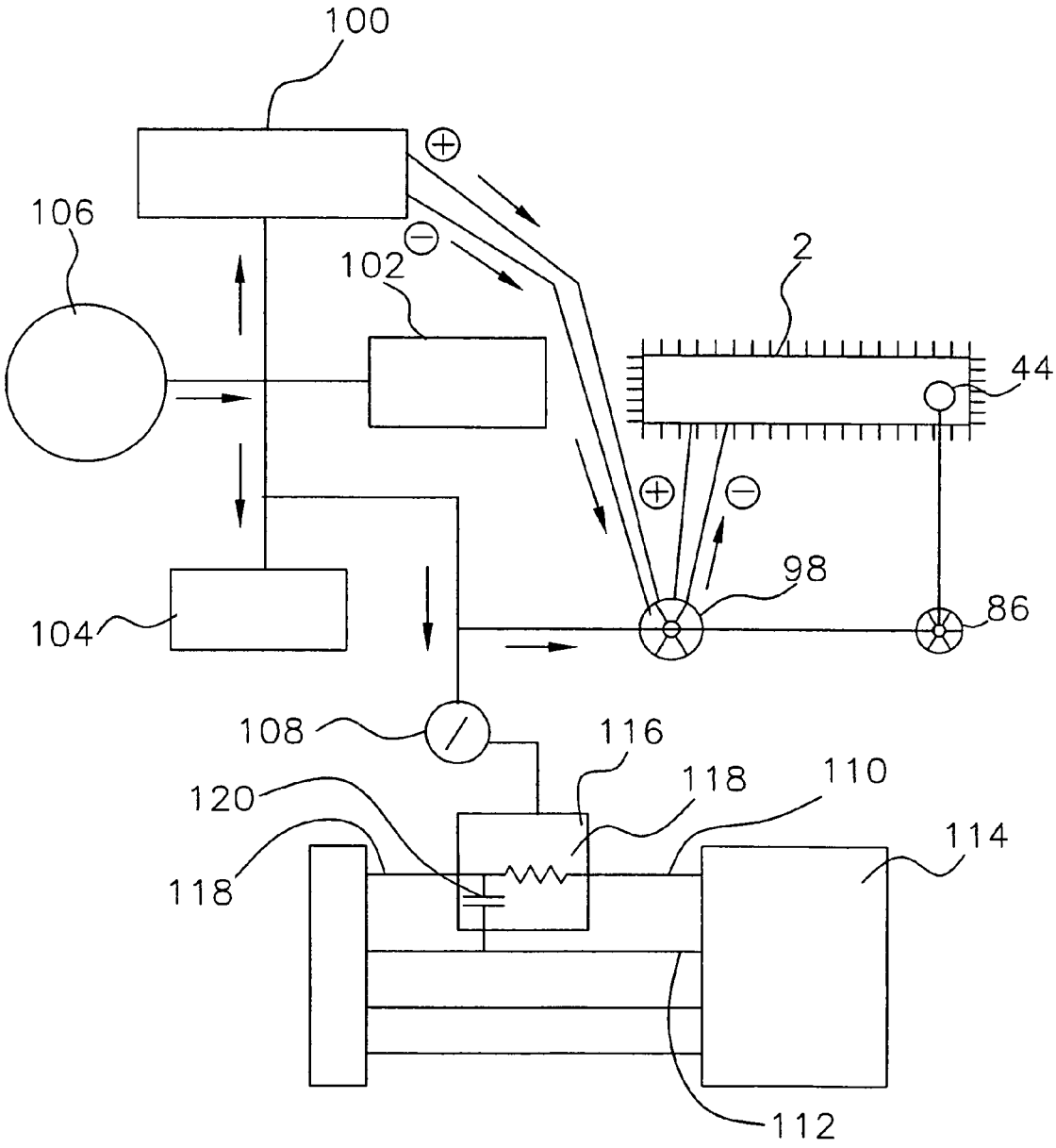
FIG. 5 is an electrical schematic showing the integration of the electrolyzer of the present invention into a vehicle.

With reference to FIGS. 4 and 5, a schematic of the plumbing and electrical operation of the present invention is provided. During operation a gaseous mixture of hydrogen and oxygen is formed by the electrolysis of water in electrolyzer 2. Electrolyzer 2 is connected to collection tank 80 by pressure line 82. The gaseous mixture is collected and temporarily stored in collection tank 80. Collection tank 80 optionally includes pressure relief valve 84 to guard against any dangerous pressure build up. Collection tank 80 is connected to solenoid 86 by pressure line 88. Solenoid 86 is in turn connected by pressure line 90 to engine intake manifold 92 of engine 94. Optionally, flash arrestor 96 is incorporated in pressure line 90 to prevent a flame from propagating in tube 88. Furthermore, pressure line 90 also includes orifice 97 to regulate the flow of the gaseous mixture into intake manifold 92. The size of this orifice will depend on the size of the engine. For example, an orifice diameter of about 0.04 is suitable for a 1 liter engine, about 0.06 inches is suitable for a 2.5 liter engine, and about 0.075 inches is suitable for a V8 engine. The applied voltage to electrolyzer 2 is provided through solenoid 98 by electrolyzer battery 100. When the pressure in collection tank 80 drops below about 25 psi, solenoid 98 switches and a voltage of about 12 V is applied between the anode electrode and cathode electrode of electrolyzer 2 Battery isolator 102 allows for charging of vehicle battery 104 and electrolyzer battery 100 by alternator 106 while keeping electrolyzer battery 100 and vehicle battery 104 electrically isolated. Furthermore, solenoid 98 is powered by vehicle battery 104 when main switch 108 is activated. Gas mixer solenoid 86 is also powered by vehicle battery 104 and open when the gas mixture is provided to intake manifold 92. Solenoid 86 also receives feedback from level sensor 44 which causes solenoid 86 to shut off gas flow is the electrolyte solution level in electrolyzer 2 gets too low. Finally, when the method and apparatus of the present invention are used in a vehicle, the operation of the vehicle's oxygen sensor needs to be adjusted to take into account the additional oxygen that is added to the fuel system from the electrolyzer. Normally, if the oxygen sensor senses more oxygen, the vehicle's computer would determine that the engine is running lean and open up the fuel injectors to a richer fuel mixture. This is undesirable and would cause poor fuel economy. Electrical lines 110, 112 of oxygen sensor 114 preferably include RC circuit 116. RC circuit 116 includes resistor 118 and capacitor 120. Preferably, resistor 118 is about 1 megaohm and capacitor 120 is about 1 microfarad. Electrical line 110 is the check engine light signal and electrical line 112 carries the control signal that is related to the amount of oxygen in a vehicle exhaust. Resistor 118 which is in series in electrical line 110 ensures that the vehicle control system interprets the oxygen sensor as operating correctly. Similarly, capacitor 120 provides the vehicle's computer with a signal such that the vehicles fuel injectors do not incorrectly open when the gas from electrolyzer 100 is being supplied to the fuel system. Finally, main switch 108 switches RC circuit in when gas is being supplied (i.e., the electrolyzer is being used) and out when gas is not being supplied.

In another embodiment of the present invention, a method for increasing the fuel efficiency of an internal combustion engine is provided. The method of this embodiment utilizes the electrolyzer described above in conjunction with an internal combustion engine. Specifically, the method comprises:

a) providing an electrolyzer comprising:

an electrolysis chamber;

an aqueous electrolyte solution comprising water and an electrolyte, the aqueous electrolyte solution partially filling the electrolysis chamber such that a gas reservoir region is formed above the aqueous electrolyte solution;

two principal electrodes comprising an anode electrode and a cathode electrode, the two principal electrodes at least partially immersed in the aqueous electrolyte solution; and one or more supplemental electrode at least partially immersed in the aqueous electrolyte solution and interposed between two principle electrodes that are not connected to the anode or cathode with a metallic conductor wherein the two principal electrodes and the one or more supplemental electrodes are held in a fixed spatial relationship;

b) applying an electrical potential between the two principal electrodes wherein a gas mixture comprising hydrogen gas and oxygen gas is generated and collected in the gas reservoir region and wherein the electrolyzer is adapted to deliver the gas mixture to the fuel system of an internal combustion engine; and c) combining the gas mixture with fuel in the fuel system of an internal combustion engine. The spatial arrangement and the properties of electrodes, the selection of the electrolyte, and the utilization of a rack and retainer to hold the electrodes are the same as set forth above. The method of the present invention further comprises a step of adjusting the operation of an oxygen sensor as set forth above.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

The invention claimed is:

1. A method for increasing the fuel efficiency of an internal combustion engine, the method comprising:

a) providing an electrolyzer for electrolyzing water into hydrogen gas and oxygen gas for use as an additive to the fossil fuels on which an internal combustion engine operates such as engines in motor vehicles, the electrolyzer comprising:

an electrolysis chamber, the electrolysis chamber having a removable cover serving as access means for performing routine maintenance to components in its interior space;

an aqueous electrolyte solution comprising water and an electrolyte, the aqueous electrolyte solution partially filling the electrolysis chamber such that a gas reservoir region is formed above the aqueous electrolyte solution;

two principal electrodes comprising an anode electrode and a cathode electrode, the two principal electrodes at least partially immersed in the aqueous electrolyte solution; and one or more supplemental electrodes at least partially immersed in the aqueous electrolyte solution and interposed between two principal electrodes that are not connected to the anode or cathode with a metallic conductor wherein the two principal electrodes and the one or more supplemental electrodes are held in a fixed spatial relationship;

means for individually removing and replacing said principal electrodes and supplemental electrodes wherein the principal and supplemental electrodes are removably insertable and attached in a rack holding said electrodes in a fixed spatial relationship, said rack further comprising a retainer for securing the electrodes to the rack and said retainer further being removably attached to the electrolysis chamber; and heat sink means for removing an excess heat generated by the electrolyzer, said means including a plurality of spaced-apart fins around at least a portion of the outside surface of the electrolysis chamber;

b) applying an electrical potential between the two principal electrodes wherein a gas mixture comprising hydrogen gas and oxygen gas is generated and collected in the gas reservoir region and wherein the electrolyzer is adapted to deliver the gas mixture to the fuel system of the internal combustion engine; and c) combining the gas mixture with fuel in the fuel system of the internal combustion engine.

2. The method of claim 1 wherein the one or more supplemental electrodes are not connected to either of the two principal electrodes with a metallic conductor

3. The method of claim 1 wherein a first group of the one or more supplemental electrodes are connected to the anode electrode with a first metallic conductor and a second group of the one or more supplemental electrodes are connected to the cathode electrode with a second metallic conductor.

4. The method of claim 1 wherein the fixed spatial relationship is such that the two principal electrodes and the one or more supplemental electrodes are essentially parallel and wherein each electrode is separated from an adjacent electrode by a distance from about 0.15 inches to about 0.35 inches.

5. The method of claim 1 wherein the one or more supplemental electrodes are 1 to 50 supplemental electrodes.

6. The method of claim 1 wherein the one or more supplemental electrodes are each individually a metallic wire mesh, a metallic plate, or a metallic plate having one or more holes.

7. The method of claim 1 wherein the one or more supplemental electrodes are each individually a metallic plate having one or more holes.

8. The method of claim 1 wherein the one or more supplemental electrodes are each individually a metallic wire mesh.

9. The method of claim 1 wherein the two principal electrodes are each individually a metallic wire mesh, a metallic plate, or a metallic plate having one or more holes.

10. The method of claim 1 wherein the two principal electrodes are each individually a metallic plate.

11. The method of claim 1 wherein the electrolyte is a bicarbonate, a hydroxide, or mixtures thereof.

12. The method of claim 1 wherein the electrolyte is sodium bicarbonate, potassium hydroxide, sodium hydroxide, or mixtures thereof.

13. The method of claim 1 wherein the electrolyzer further comprises a pressure relief valve.

14. The method of claim 1 wherein the electrolyzer further comprises an outlet adapted to introduce the gas mixture into a fuel system of an internal combustion engine.

15. The method of claim 1 further comprising adjusting the operation of an oxygen sensor so that the oxygen sensor does not cause a fuel rich condition.

16. The method of claim 15 wherein the operation of the oxygen sensor is adjusted by an RC circuit, the RC circuit includes:

a resistor placed in series with the oxygen sensor's check engine light electrical line; and a capacitor placed between the oxygen sensor's control line that monitors the amount of oxygen and the check engine light electrical line, wherein the capacitor is attached to the check engine electrical line at the opposite side of the resistor from where the resistor is in electrical contact with the oxygen sensor.

* * * * *